US008539967B2

(12) United States Patent
Wurster

(10) Patent No.: US 8,539,967 B2
(45) Date of Patent: Sep. 24, 2013

(54) SPRAY PRETREATMENT SYSTEM AND METHOD FOR PRE-TREATING WORKPIECES BY SPRAYING

(75) Inventor: Gerd Wurster, Stuttgart (DE)

(73) Assignee: Gerd Wurster, Stuttgart (DE)

( * ) Notice: Subject to any disclaimer, the term of this patent is extended or adjusted under 35 U.S.C. 154(b) by 515 days.

(21) Appl. No.: 11/800,834

(22) Filed: May 8, 2007

(65) Prior Publication Data

US 2008/0276974 A1 Nov. 13, 2008

(51) Int. Cl.
*B08B 3/04* (2006.01)

(52) U.S. Cl.
USPC ..... 134/104.2

(58) Field of Classification Search
USPC ..... 134/104.2, 105
See application file for complete search history.

(56) References Cited

U.S. PATENT DOCUMENTS

| | | | | |
|---|---|---|---|---|
| 3,934,432 | A * | 1/1976 | Fleissner | 68/5 D |
| 5,113,882 | A * | 5/1992 | Gileta | 134/19 |
| 5,246,024 | A * | 9/1993 | Uchino | 134/64 R |
| 5,823,210 | A * | 10/1998 | Inada et al. | 134/105 |

FOREIGN PATENT DOCUMENTS

| | | | |
|---|---|---|---|
| DE | 4333932 A1 | | 4/1995 |
| GB | 887159 | | 1/1962 |
| GB | BG 887159 | * | 1/1962 |

* cited by examiner

*Primary Examiner* — Michael Kornakov
*Assistant Examiner* — David Cormier
(74) *Attorney, Agent, or Firm* — Bracewell & Giuliani LLP

(57) ABSTRACT

The invention discloses a spray pretreatment system and a method for pre-treating workpieces by spraying in a spraying tunnel, wherein the workpieces are fed into a treating station through an entry station. The inlet opening of the entry station is located below the level of the treating installations of the treating station. In this way, partial condensation of the vapors escaping from the treating station occurs in the entry station so that one can do without an extraction system in the area of the roof surface of the spraying tunnel. If desired, an extraction system with relatively low capacity may be provided in the region of the inlet opening.

21 Claims, 3 Drawing Sheets

SPRAY PRETREATMENT SYSTEM AND METHOD FOR PRE-TREATING WORKPIECES BY SPRAYING

BACKGROUND OF THE INVENTION

The present invention relates to a spray pretreatment system comprising a spraying tunnel, in which is provided a treating station with treating installations for the treatment of workpieces by spraying or flooding, the treating installations being supplied with a treating liquid from a tank located below the station, and further comprising a conveyor for transporting workpieces through the spraying tunnel.

The invention further relates to a method for the spray pretreatment of workpieces where the workpieces are transported through a spraying tunnel and are treated with liquid from treating installations in at least one treating station and where the workpieces are fed in through an inlet opening.

A device and a method of the kind described above are known from DE 43 33 932 A1.

Systems of that kind serve for pre-treating workpieces with liquids and chemicals before the workpieces are subjected to a painting treatment or a color powder coating process, for example. A typical pretreatment consists, for example, of a cleaning operation where the workpieces are initially treated with a cleaning liquid before they are rinsed in several stations. In order to permit efficient cleaning, the cleaning liquid is supplied, preferably, at an increased temperature of between 50 and 70° C., for example. As a rule, the workpieces are transported through the spray pretreatment system using a continuously driven conveyor.

Given the fact that such spray pretreatment systems mostly have large passage openings, the resulting energy consumption is of course relatively high. As the workpieces are fed into the system through the inlet opening in horizontal direction, and as it is practically impossible, due to the continuously moving conveyor, to close off the inlet opening from ambient air, it is necessary to arrange a correspondingly sized extraction fan in the roof area of the spray pretreatment system. This leads to quite considerable energy demands.

SUMMARY OF THE INVENTION

In view of this it is a first object of the invention to disclose a spray pre-treatment system which is capable of reducing the energy consumption compared with prior designs known in the art.

It is a second object of the invention to disclose a method for the pre-treatment of workpieces by spraying which is capable of reducing the energy consumption compared with prior methods known in the art.

These and other objects are achieved in a spray pretreatment system of the kind described above in that the pre-treating station or region is preceded by an entry station or region wherein the workpieces, having been fed in through an inlet opening, are raised by the conveyor to a treating station or region located on a higher level.

The object is further achieved by a method for pre-treating workpieces by spraying wherein the workpieces are transported through a spraying tunnel and are treated with a liquid from treating installations in at least one treating station or region, and wherein the workpieces are initially fed in through an inlet opening and are then raised to a higher level in the treating station or region.

According to the invention, the spray pretreatment system comprises an inlet opening that is located below the level of the treating system. Due to the vapor pressure resulting from the higher temperature prevailing in the treating station of, for example, 50 to 70° C., the vapor has a considerable tendency to escape through the inlet opening in the case of conventional spray pretreatment systems where the workpieces are fed in at the same level at which they later reach the treating station.

This condition is largely remedied by the invention due to the fact that the inlet opening is lowered relative to the level of the spraying tunnel. Formation of vapor at the inlet opening is thereby clearly reduced, and in addition the workpieces are pre-heated in the entry station to the temperature prevailing in the treating station. In addition, the droplets and aerosols forming in the colder entry station lead to an additional cleaning effect in the entry station.

This has the result that the treating station or the further treating stations may be reduced a little in overall length or may be operated at a somewhat lower temperature. This also contributes to reducing energy consumption. Especially high energy savings are, however, achieved by the fact that the fan power needed for preventing vapor from escaping through the inlet opening can be clearly reduced or, depending on the particular configuration of the system, that one can do without an extraction system (suction device).

Conveniently, a drip pan for liquid is provided in the entry station.

According to an advantageous further development of the invention, the inlet opening has an upper edge located at a level below the treating installations at the lowest level.

According to another embodiment of the invention, the tank of the treating station is equipped with an admission surface which preferably is inclined toward the tank, the upper edge of the inlet opening being located at a level below the admission surface.

These features clearly reduce the formation of vapor at the inlet opening. The more the upper edge of the inlet opening is displaced in downward direction, the greater the energy savings are as a further cooling effect and reduction of the vapor pressure will be obtained.

Vapors from the treating station will condense especially on the upside of the entry station, which preferably is formed by an inclined surface, whereby the generation of vapor at the inlet opening is reduced.

Additionally, an extraction means may be provided in the area of the inlet opening.

Depending on the particular configuration of the spray pretreatment system, that feature may also be fully omitted in some cases.

According to a further embodiment of the invention, the conveyor is given a design ensuring that the workpieces are lowered to a lower level at the outlet of the spraying tunnel or in an intermediate zone.

The spraying tunnel may have an outlet opening with an upper edge located at a level below the treating installations arranged at the lowest level.

Although generally the temperature is lower in the outlet area of the spraying tunnel, because the only liquids used in that area are rinsing liquids, that feature also helps save energy.

Additionally, an extraction system (suction device) may be provided in the area of the outlet opening, if desired.

According to another embodiment of the invention, a cold trap is provided in the area of the inlet opening. The cold trap may consist, for example, of cooling coils and a coolant flowing through them. The entry station may be extended correspondingly by the length of such a cold trap so that the cold trap will have to be passed as a first step. Alternatively, the cold trap may be provided, for example, above and, if desired, additionally below the inlet opening.

Such a cold trap likewise efficiently prevents vapor from escaping through the inlet opening. In this case, one can do without any extraction system. This is highly valuable environmentally, especially when highly alkaline cleaning agents or highly acidic cleaning agents are used.

It is understood that the features of the invention mentioned above and those yet to be explained below can be used not only in the respective combination indicated, but also in other combinations or in isolation, without leaving the scope of the invention.

BRIEF DESCRIPTION OF THE DRAWINGS

Further features and advantages of the invention will become apparent from the description that follows of a preferred embodiment of the invention, with reference to the drawing. In the drawings.

DETAILED DESCRIPTION OF THE PREFERRED EMBODIMENTS

Figure 1:
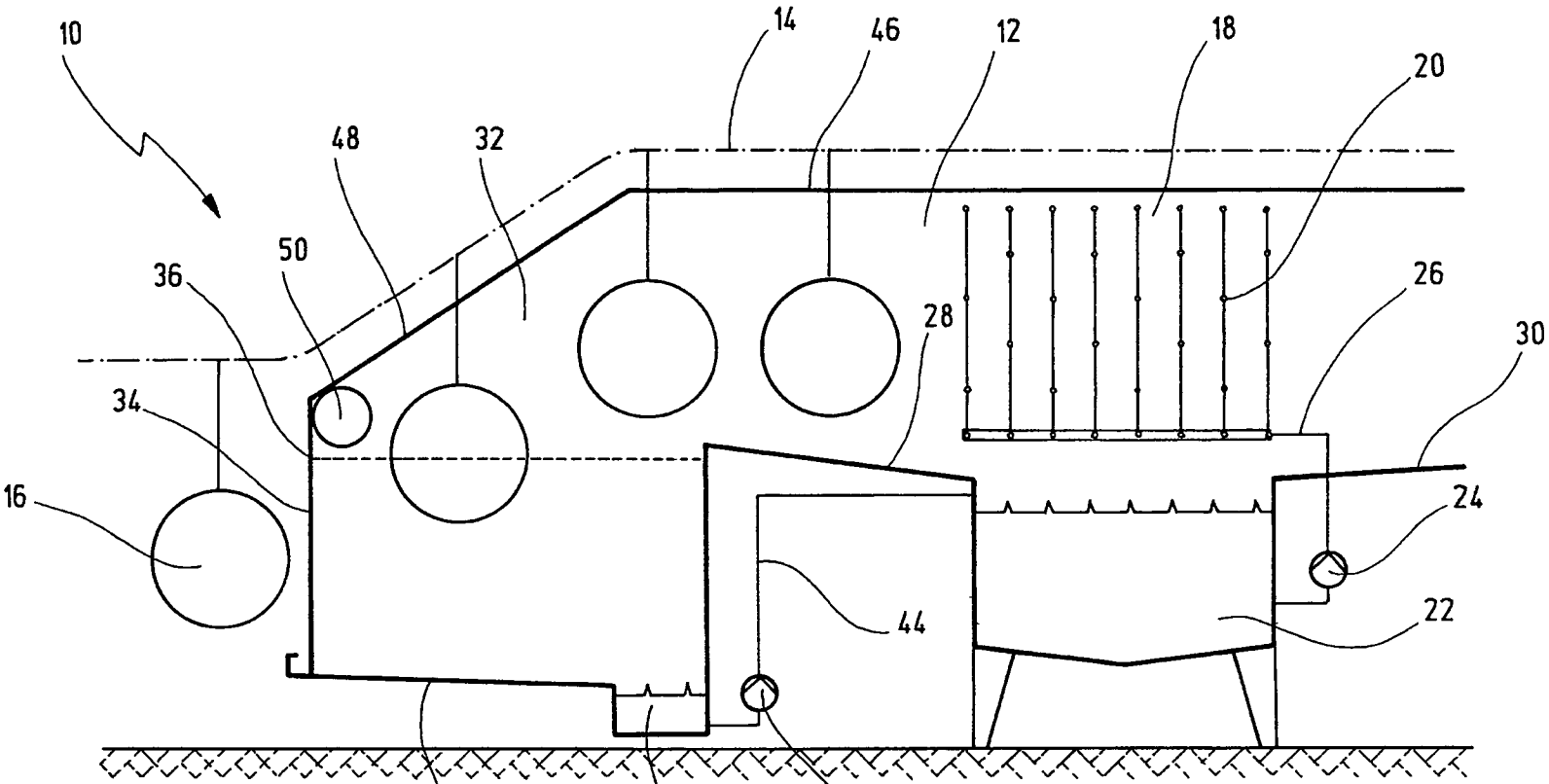
FIG. 1 shows a first embodiment of a spray pretreatment system according to the invention.

In FIG. 1, a first embodiment of a spray pretreatment system according to the invention is shown in part and is indicated by reference numeral 10.

The spray pretreatment system 10 comprises a spraying tunnel 12 through which workpieces 16 are conveyed using a conveyor 14.

The spraying tunnel 12 comprises an entry station 32 that has an inlet opening 34 with an upper edge 36. The upside of the entry station is formed by an upwardly inclined surface 48. The entry station 32 is followed by a treating station 18, which may be followed by further stations not shown in detail in the drawing. The bottom of the entry station is formed by an inclined admission surface that extends from the inlet opening 34 to a drip pan 38. The drip pan 38 is followed by a section that extends in vertically upward direction and that terminates in a tank 22 placed on the bottom of the treating station 18, via an inclined admission surface 28. Above the tank 22, there are provided treating installations 20 for the spray pretreatment of workpieces 16 at a higher temperature of, for example, 50 to 70° C. The treating installations 20 may consist, for example, of spray registers from which the workpieces are spayed by nozzles. The spray registers are supplied with cleaning liquid from the tank 22 via a pump 24 and a line 26, for spraying the workpieces 16.

Any condensate forming in the entry station 32 is collected in the drip pan 38 and is likewise recirculated to the tank 22 of the treating station 18, via a pump 42 and a line 44.

Now, the arrangement is such that the upper edge 36 of the inlet opening 34 of the entry station 32 is located at a level below the upper end of the admission surface 28 and below the treating installations 20 located at the lowest level.

Though vapors arising in operation in the treating station 18 will reach the entry station 32 via the connection area of the spraying tunnel in the region of the inclined admission surface 28, they will for the greatest part condense on the inclined surface 48 and the cold workpieces 16, and will then drop down and be carried back into the drip pan 38 via the inclined admission surface 40.

The workpieces 16 pass the inlet opening 34 and enter the entry station 32 where they are transported in an obliquely upward direction until they reach the level at which they will be conveyed through the treating station 18. On their way, they are additionally cleaned by droplets and aerosols in the area of the entry station 32. This results for example in a preliminary degreasing effect. In addition the workpieces, as well as the atmosphere in the entry station 32, are preheated gradually on the way to the treating station 18.

As a result of the considerable condensation effect in the area of the entry station 32 and of the low arrangement of the upper edge 36 of the inlet opening 34, the extraction system in the area of the roof 46 of the spraying tunnel 12, which is required in the systems of the prior art, may be fully omitted. If desired, an extraction system 50 may be installed additionally in the area of the inlet opening 34, in which case a relatively low exhaust capacity will be required only. All in all, that arrangement leads to considerable energy savings compared with known spray pretreatment systems.

Figure 2:
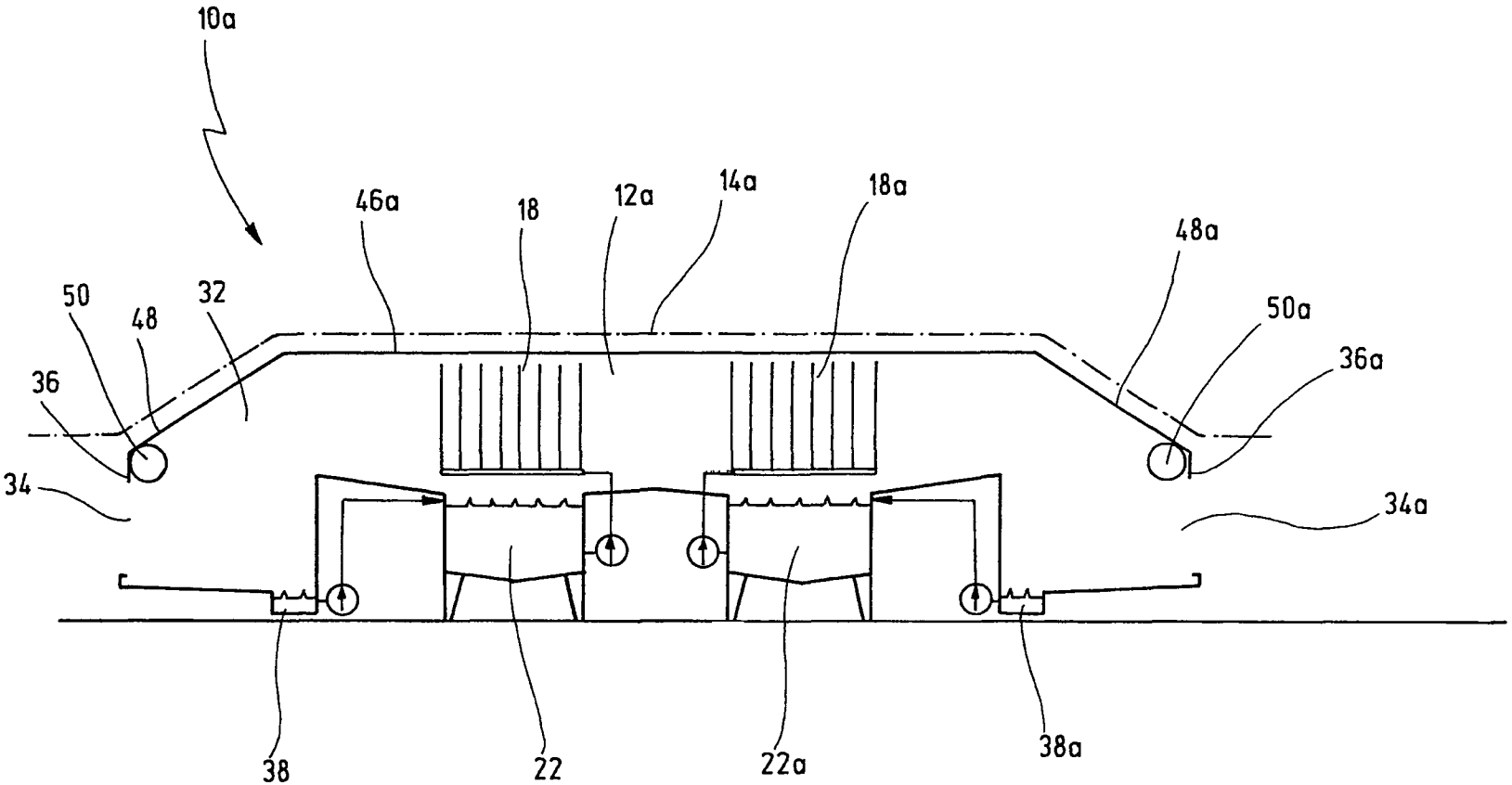
FIG. 2 shows an alternative embodiment of a spray pretreatment system according to the invention comprising two spray treating stations.

FIG. 2 shows another embodiment of a spray pretreatment system according to the invention, indicated generally be reference numeral 10*a*. Identical parts are identified in this drawing by the same reference numerals.

The design of the first part of the spray pretreatment system 10*a* is identical to that of the system discussed with reference to FIG. 1. In the present case, however, a second treating station 18*a*, following the first treating station 18, is shown by way of example. While the first treating station 18 may serve for example for cleaning the workpieces, the second cleaning station 18*a* may be designed as a rinsing station that operates at clearly lower temperatures of, for example, approximately 30° C. For the rest, the two treating stations 18, 18*a* may be identical in design, to the extent this is suitable for the particular application (for example preliminary degreasing and degreasing).

The outlet end of the spraying tunnel 12*a* may again be provided with a corresponding inclined surface 48*a* that extends in downward direction to the upper edge 36*a* of an outlet opening 34*a*. And again, a drip pan 38*a* may be provided on the bottom, from which the collected liquid can be recirculated into the tank 22*a* of the treating station 18*a*. Similarly, an extraction system 50*a* may be provided in the area of the outlet opening 34*a*, to the extent such a system is required for the particular application.

It is understood that such a spray pretreatment system may of course comprise significantly more treating stations than have been illustrated in FIGS. 1 and 2 by way of example. For example, several treating stations may be followed by several rinsing stations.

Figure 3:
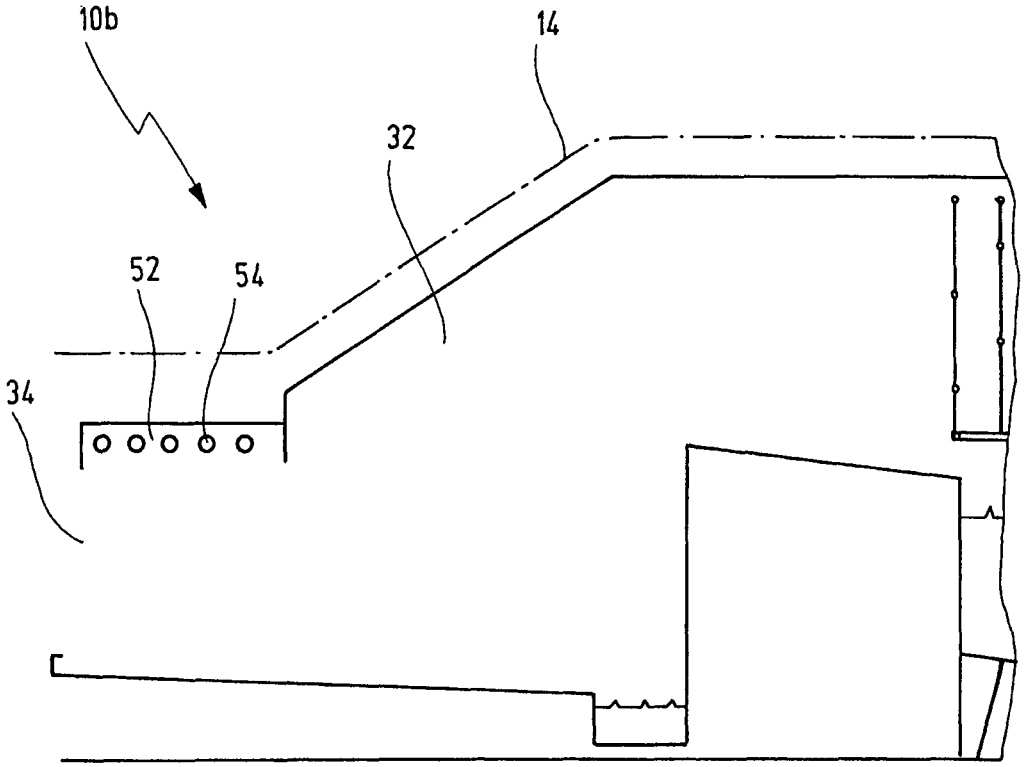
FIG. 3 shows a partial view of another embodiment of a spray pre-treatment system according to the invention, illustrating the area of the entry station.
Figure 4:
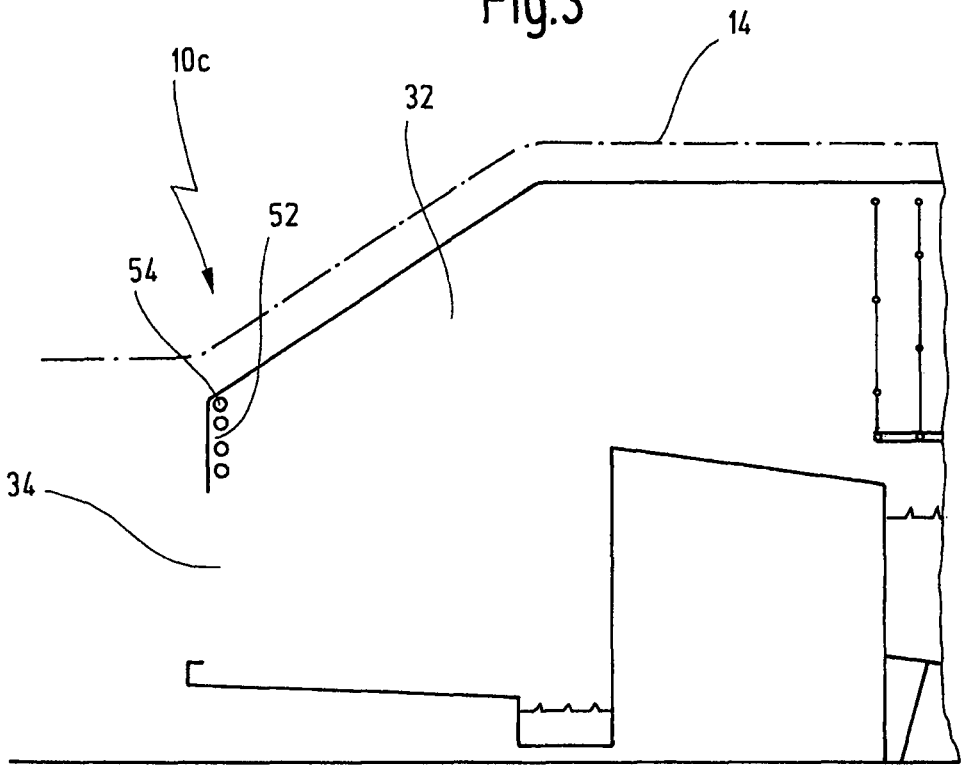
FIG. 4 shows a partial view of another embodiment of a spray pre-treatment system according to the invention, illustrating the area of the entry station.

FIGS. 3 and 4 show the area of the entry station of certain modified designs of the spray pretreatment system according to the invention, indicated by reference numerals 10*b* or 10*c*, respectively. As before, identical elements are again identified by the same reference numerals.

In both embodiments shown, a cold trap 52 is provided in the area of the inlet opening 34 of the entry station. The cold trap 52 comprises a plurality of pipes 54 with a cooling liquid flowing through the pipes.

In the case of the embodiment shown in FIG. 3, the entry station 32 is extended to the front by the cold trap 54 so that workpieces 16 fed into the station will have to pass the cold trap 54 first.

In the case of the embodiment illustrated in FIG. 4, the cold trap 54 is arranged above the inlet opening 34.

In both cases, no extraction system is needed in the area of the inlet opening. This is especially valuable environmentally when highly alkaline or highly acidic cleaning agents are used in the cleaning station.

All in all, the structure according to the invention leads to clear energy savings compared with conventional spray pretreatment systems.

What is claimed is:

1. A spray pretreatment system comprising:

a spraying tunnel;

an entry region located within said spraying tunnel and followed by at least one treating region comprising at least one treating installation comprising nozzles for treating workpieces by spraying or flooding an aqueous solution comprising water and chemicals onto the workpieces;

a collecting tank located below said treating installation for collecting the aqueous solution from said treating installation;

a pump for supplying the aqueous solution from said collecting tank to said treating installation; and a conveyor for transporting workpieces through said spraying tunnel;

wherein said entry region comprises an inlet opening having an upper edge located at a level below said treating installation;

wherein said conveyor is configured for feeding workpieces from outside said inlet opening through said inlet opening, for lifting said workpieces from said inlet opening to said treating installation located on a higher level, and for lowering said workpieces from said at least one treatment installation to an intermediate zone or an outlet of said spraying tunnel;

wherein said upper edge of said inlet opening is on a lower level than said nozzles so that vapor escaping from said aqueous solution sprayed through said nozzles or from said aqueous solution collected within said collecting tank is maintained within said spraying tunnel;

wherein said inlet opening and said nozzles positioned to be in gaseous communication with an ambient environment outside said entry region through the entry region during treating of the workpieces by spraying or flooding the aqueous solution comprising water and chemicals onto the workpieces.

2. A spray pretreatment system comprising:

a spraying tunnel;

an entry region located within said spraying tunnel and followed by at least one treating region comprising at least one treating installation comprising nozzles for treating workpieces by spraying or flooding a solution onto workpieces;

a collecting tank located below said treating installation for collecting the solution from said treating installation;

a pump for supplying the solution from said collecting tank to said treating installation; and a conveyor for transporting workpieces through said spraying tunnel;

wherein said entry region comprises an inlet opening having an upper edge located at a level below said treating installation;

wherein said upper edge of the inlet opening is on a lower level than said nozzles so that vapor escaping from said solution sprayed through said nozzles or from said solution collected within said collecting tank is maintained within said spraying tunnel;

wherein said inlet opening and said nozzles positioned to be in gaseous communication with an ambient environment outside said entry region through the entry region during treating of the workpieces by spraying or flooding the solution onto the workpieces.

3. The spray pretreatment system of claim 1, wherein said conveyor is configured for feeding workpieces from outside said inlet opening through said inlet opening and for lifting said workpieces from said inlet opening to said treating installation located on a higher level.

4. The spray pretreatment system of claim 1, wherein said entry region further comprises a drip pan for collecting liquid within said entry region, the drip pan vertically spaced apart from upper edge of the inlet opening to thereby bound the inlet opening, the drip pan inclined toward the collecting tank.

5. The spray pretreatment system of claim 3, further comprising an admission surface leading toward said tank positioned adjacent an opening of the collecting tank, extending away from the collecting tank in a direction of the inlet opening along a substantial portion of a pathway of the conveyor, and configured to capture condensate.

6. The spray pretreatment system of claim 5, wherein said admission surface is inclined toward said collecting tank.

7. The spray pretreatment system of claim 6, wherein said upper edge of said inlet opening is located at a level below at least a portion of said admission surface approached by said workpieces prior to reaching the treating region.

8. The spray pretreatment system of claim 4, further comprising a suction device located in the vicinity of said inlet opening positioned to retrieve condensate encountered by the drip pan.

9. The spray pretreatment system of claim 2, wherein said conveyor is configured for lowering workpieces from said at least one treatment installation to an intermediate zone or an outlet of said spraying tunnel.

10. The spray pretreatment system of claim 1, wherein said spraying tunnel further comprises an outlet opening having an upper edge located at a level below said at least one treating installation positioned to be in gaseous communication with the ambient environment outside said outlet opening through the outlet opening during treating of the workpieces by spraying or flooding the aqueous solution onto the workpieces.

11. The spray pretreatment system of claim 10, further comprising a suction device located in the vicinity of said outlet opening positioned to retrieve condensate adjacent the outlet opening and to return the condensate to the collecting tank.

12. The spray pretreatment system of claim 2, further comprising a cold trap located in the region of said inlet opening, the cold trap comprising coolant flowing therethrough.

13. The spray pretreatment system of claim 2, wherein said entry region further comprises a drip pan for collecting liquid within said entry region, the drip pan vertically spaced apart from the upper edge of the inlet opening to thereby bound the inlet opening, the drip pan included toward the collecting tank.

14. The spray pretreatment system of claim 13, further comprising an admission surface leading toward said tank positioned adjacent an opening of the collecting tank, extending away from the collecting tank in a direction of the inlet opening along a substantial portion of a pathway of the conveyor, and configured to collect condensate.

15. The spray pretreatment system of claim 14, wherein said admission surface is inclined toward said tank.

16. The spray pretreatment system of claim 15, wherein said upper edge or said inlet opening is located at a level below at least a portion of said admission surface approached by said workpieces prior to reaching the treating region.

17. The spray pretreatment system of claim 1, wherein the spraying tunnel is devoid of a fan or extraction system to control and to prevent vapor escaping from the aqueous solution sprayed through the nozzles and the aqueous solution collected within the collecting tank, from escaping the spraying tunnel, the treating installation positioned to be in gaseous communication with the ambient environment through the entry region or an outlet region of an outlet of the spraying tunnel for the workpieces during treating of the workpieces by spraying or flooding the aqueous solution onto the workpieces.

18. The spray pretreatment system of claim 2, wherein the spraying tunnel is devoid of a fan or extraction system to control and to prevent vapor escaping from the solution sprayed through the nozzles and the solution collected within the collecting tank from escaping the spraying tunnel, the treating installation positioned to be in gaseous communication with the ambient environment through the entry region or an outlet region of an outlet of the spraying tunnel for the workpieces during treating of the workpieces by spraying or flooding the solution onto the workpieces.

19. The spray pretreatment system of claim 2, wherein said entry region further comprises a drip pan for collecting liquid within said entry region, the drip pan inclined toward the collecting tank.

20. The spray pretreatment system of claim 2, wherein said conveyor is configured for feeding workpieces from outside said inlet opening through said inlet opening and for lifting said workpieces from said inlet opening to said treating installation located on a higher level;

wherein the spray treatment system further comprises an admission surface leading toward said tank positioned adjacent an opening of the collecting tank, extending away from the collecting tank in a direction of the inlet opening along a substantial portion of a pathway of the conveyor, and configured to capture condensate; and wherein said admission surface is inclined toward said collecting tank.

21. The spray pretreatment system of claim 20, wherein said upper edge of said inlet opening is located at a level below at least a portion of said admission surface approached by said workpieces prior to reaching the treating region.

* * * * *